US006448864B1

(12) United States Patent
Hiroshima et al.

(10) Patent No.: US 6,448,864 B1
(45) Date of Patent: Sep. 10, 2002

(54) BALANCED-UNBALANCED CONVERTING CIRCUIT, BALANCED-UNBALANCED CONVERTER, AND COMMUNICATION DEVICE INCLUDING THE SAME

(75) Inventors: Motoharu Hiroshima, Ishikawa-ken; Shohachi Nishijima, Komatsu; Hideyuki Kato, Ishikawa-ken, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/714,763

(22) Filed: Nov. 16, 2000

(30) Foreign Application Priority Data

Nov. 16, 1999 (JP) ..... 11-325726
Aug. 29, 2000 (JP) ..... 2000-259654

(51) Int. Cl.[7] ..... H01P 5/10
(52) U.S. Cl. ..... 333/26; 333/109
(58) Field of Search ..... 333/26, 109, 124

(56) References Cited

U.S. PATENT DOCUMENTS 4,651,344 A * 3/1987 Hasegawa et al. ..... 333/26
5,293,175 A * 3/1994 Hemmie et al. ..... 343/795
5,497,137 A 3/1996 Fujiki ..... 336/200
5,880,646 A 3/1999 Vannatta et al. ..... 333/26
6,294,965 B1 * 9/2001 Merrill et al. ..... 333/26

FOREIGN PATENT DOCUMENTS

EP 10454696 A2 10/2000

OTHER PUBLICATIONS

European Search Report dated Feb. 11, 2002.

* cited by examiner

*Primary Examiner*—Justin P. Bettendorf
*Assistant Examiner*—Joseph Chang
(74) *Attorney, Agent, or Firm*—Ostrolenk, Faber, Gerb & Soffen, LLP

(57) ABSTRACT

Inner conductor formation holes having inner conductors formed on the inner walls thereof are formed in a dielectric block. Both of the ends of one of the inner conductors are open and led out as terminal electrodes which function as balanced ports. Both of the ends of another inner conductor are connected to an outer conductor to be grounded, and the center portion of the inner conductor between the ends is led out as a terminal electrode which functions as an unbalanced port. The circuit can also be realized with striplines or microstriplines on a dielectric substrate. Thus, a balanced-unbalanced converter having these terminal electrodes as balanced and unbalanced ports is formed.

9 Claims, 7 Drawing Sheets

FIG. 7A
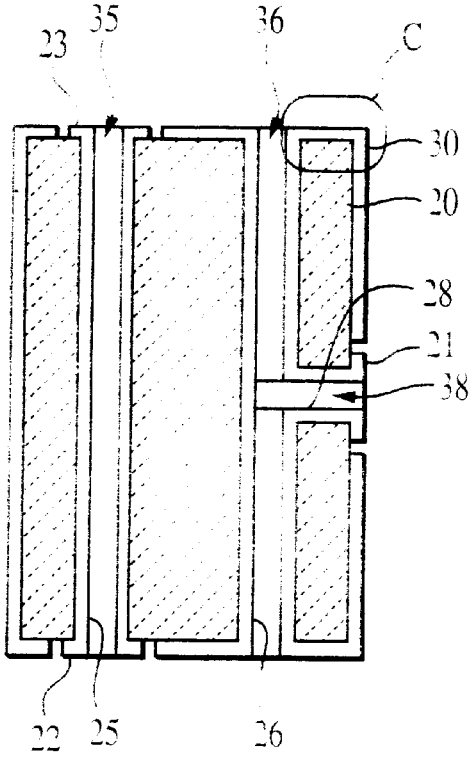
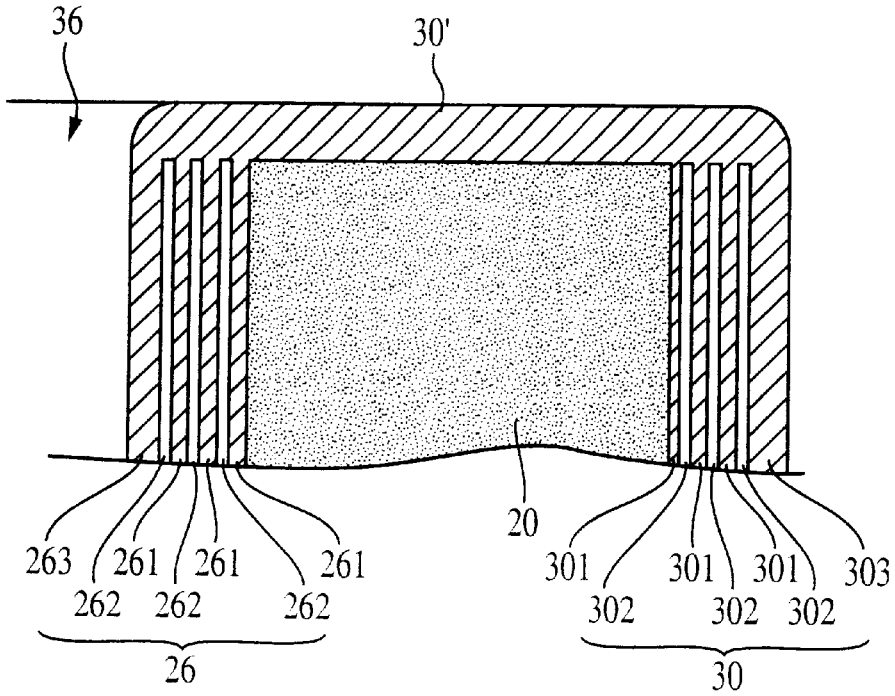
FIG. 7B

BALANCED-UNBALANCED CONVERTING CIRCUIT, BALANCED-UNBALANCED CONVERTER, AND COMMUNICATION DEVICE INCLUDING THE SAME

BACKGROUND OF THE INVENTION

1. Field of the Invention

The present invention relates to a balanced-unbalanced converting circuit, a balanced-unbalanced converter, which are for operation in a high frequency band, and a communication device including the same.

2. Description of the Related Art

The Marchand balun circuit shown in FIG. 9 is a known wideband balanced-unbalanced converting circuit. In FIG. 9, transmission lines 5*a*, 5*b*, 6*a*, and 6*b* each having a quarter-wavelength at an operating frequency are shown. One end of each of the transmission lines 6*a* and 6*b* is grounded, and the other ends thereof are signal input-output ports 2 and 3, respectively. One end of the transmission line 5*b* is open, and the other end thereof is connected to one end of the transmission line 5*a*. The other end of the transmission line 5*a* is a signal input-output port 1.

With this configuration, the transmission lines 5*a* and 5*b* and the transmission lines 6*a* and 6*b* are coupled via electromagnetic fields, respectively, so that a phase difference of 180° is produced between the open end of the transmission line 5*b* and the signal input-output port 1 of the transmission line 5*a*. Accordingly, this circuit functions as a balun in which the ports 2 and 3 act as balanced ports, and the port 1 acts as an unbalanced port.

U.S. Pat. 5,880,646 discloses a balanced-unbalanced converter including coaxial transmission lines. In the balanced-unbalanced converter, two quarter-wavelength transmission lines are provided in a dielectric block. A transmission line is formed on the outer surface of the dielectric block so as to connect first ends of the respective two transmission lines to each other. The second ends of the two transmission lines are balanced ports, and an unbalanced port is defined between the second end of one of the two transmission lines and ground.

In a conventional Marchand balun circuit as shown in FIG. 9, generally, the transmission lines 5*a*, 5*b*, 6*a*, and 6*b* are formed on a dielectric substrate. Therefore, the Q value of the transmission lines is low, and in some cases, unnecessary radiation becomes a problem. Furthermore, in a balanced-unbalanced converting circuit containing coaxial transmission lines as disclosed in the above-mentioned U.S. Pat. 5,880,646, the transmission line extends a distance of a half-wavelength from one of the balanced ports. Accordingly, a loss caused by this transmission line deteriorates the balance characteristic (the difference between the amplitudes at the balanced ports).

Further, if the Marchand balun circuit shown in FIG. 9 is formed by use of a dielectric coaxial line, it is necessary to provide a transmission line with a length of a half-wavelength (total of the transmission lines 5*a* and 5*b*) and transmission lines 6*a* and 6*b* in parallel to the half-wavelength transmission line in a dielectric block. This causes the interval between the open ends of the quarter-wavelength transmission lines 6*a* and 6*b* to be excessively short. Thus, from a structural standpoint, it becomes difficult to form the balanced input-output ports 2 and 3.

In the conventional Marchand balun circuit, one unbalanced signal is converted to one balanced signal, or vice versa. That is, the conventional Marchand balun circuit is not capable of demultiplexing one balanced signal into two unbalanced signals, nor of multiplexing two unbalanced signals to provide as one balanced signal.

SUMMARY OF THE INVENTION

Accordingly, the present invention provides a balanced-unbalanced converting circuit, a balanced-unbalanced converter, which are effective in solving problems caused by an excessively short interval between the above-mentioned balanced ports, and can be effectively operated e.g., in a frequency band which is higher than the quasi-microwave band, and a communication device including the same.

The present invention further provides a balanced-unbalanced converting circuit and a balanced-unbalanced converter, which are formed by use of coaxial transmission lines, respectively, in which the loss caused by the transmission lines is reduced, and deterioration of the balance characteristic is prevented, and a communication device including the same.

The present invention also provides a balanced-unbalanced converting circuit and a balanced-unbalanced converter, each of which is able to multiplex two unbalanced signals with different frequencies, which are output from, e.g., two voltage control oscillators, and wherein the outputs are mixed, that is, the two unbalanced signals are multiplexed and thereby converted to one balanced signal, and a communication device including the same.

To achieve these objects, according to a first aspect of the present invention, there is provided a balanced-unbalanced converting circuit which comprises a first transmission line having both ends open, and a second transmission line having both ends grounded, arranged substantially in parallel to the first transmission line, and having an electrical length substantially equal to the electrical length of the first transmission line, the first transmission line having balanced ports connected to both of the ends thereof, the second transmission line having an unbalanced port connected substantially to the center thereof.

As described above, by connecting the balanced ports to the two ends of the first transmission line, respectively, the interval between the balanced ports is wide, so that the balanced ports can be easily formed. Moreover, unnecessary coupling between the balanced ports can be reduced, and an excellent balance characteristic can be obtained.

Preferably, in a second aspect of the invention, the balanced-unbalanced converting circuit comprises a first transmission line having both ends open, and second and third transmission lines arranged substantially in parallel to the first transmission line, the third transmission line having an electrical length substantially equal to that of the first transmission line and different from that of the second transmission line, and having both ends grounded, the first transmission line having balanced ports connected to both of the ends thereof, the second and third transmission lines each having an unbalanced port connected substantially to the center thereof. Thereby, a balanced-unbalanced converting circuit provided with one balanced port and two unbalanced ports, corresponding to two frequencies, can be obtained. That is, the balanced-unbalanced converting circuit can multiplex or demultiplex a signal, in addition to the balanced-unbalanced signal converting function.

Also preferably, in a third aspect of the invention, the electrical length of the first transmission line is in the range between the electrical lengths of the second and third transmission lines. By reducing the difference between the electrical lengths of the first and second transmission lines, and the difference between the electrical lengths of the first and third transmission lines, respectively, a good balanced-unbalanced conversion characteristic can be obtained with respect to two frequency bands.

Preferably, in the balanced-unbalanced converter, the first and second transmission lines in the above-described balanced-unbalanced converting circuit each comprise a microstrip line or strip line produced by forming a conductor film on a dielectric substrate. Thereby, the balanced-unbalanced converter can be easily formed on the dielectric substrate and the balanced-unbalanced converter can be easily connected to another high frequency circuit to be formed on the dielectric substrate.

Also preferably, in the balanced-unbalanced converter, the first and second transmission lines in the above-described balanced-unbalanced converting circuit each comprise a dielectric coaxial transmission line produced by forming a conductor film in a dielectric block. Thereby, a small-sized balanced-unbalanced converter having a low loss and a low unnecessary radiation characteristic can be formed.

Furthermore, at least a part of one or more of the conductor films may be a thin film lamination electrode having an area in which plural thin film conductor layers and plural thin film dielectric layers, each having a thickness smaller than the skin depth at an operating frequency are alternately laminated. Thereby, a low loss can be attained.

Furthermore, according to the present invention, there is provided a communication device which comprises the above-described balanced-unbalanced converter provided, e.g., in a high frequency circuit section. Thereby, a communication device reduced in size and having high efficiency can be provided.

Other features and advantages of the present invention will become apparent from the following description of embodiments of the invention which refers to the accompanying drawings, in which like references denote like elements and parts.

BRIEF DESCRIPTION OF THE DRAWINGS

FIG. 7A is a cross section of a balanced-unbalanced converter according to a fifth embodiment of the present invention;

FIG. 7B is a fragmentary cross section of the balanced-unbalanced converter;

DESCRIPTION OF EMBODIMENTS OF THE INVENTION

The configuration of a balanced-unbalanced converter according to a first embodiment of the present invention will be described with reference to FIGS. 1 and 2.

Figure 1:
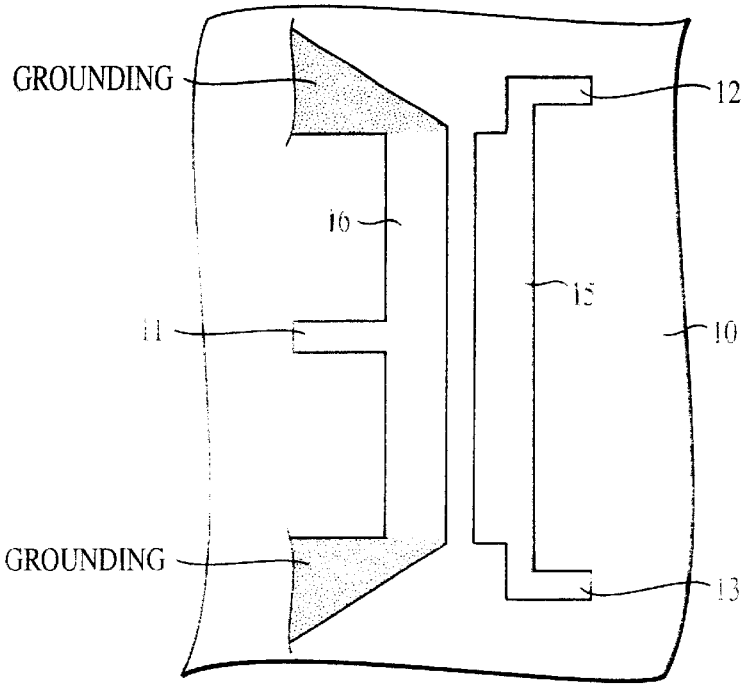
FIG. 1 illustrates the configuration of a balanced-unbalanced converter according to a first embodiment of the present invention.

FIG. 1 is a plan view of the balanced-unbalanced converter. Strip line electrodes 15 and 16 are arranged, adjacently in parallel to each other on the upper face of a dielectric substrate 10. An earth electrode is formed so as to extend substantially on the whole of the under face of the dielectric substrate 10. The dielectric substrate 10, the strip line electrodes 15 and 16, and the earth electrode constitute microstrip lines, respectively. A terminal electrode 11 is led out from the center of the strip line electrode 16, and terminal electrodes 12 and 13 are led out from the ends of the strip line electrode 15, respectively. Both of the ends of the strip line electrode 16 are patterned so as to be connected to earth electrodes, respectively, provided on the upper face of the dielectric substrate 10.

Figure 2:
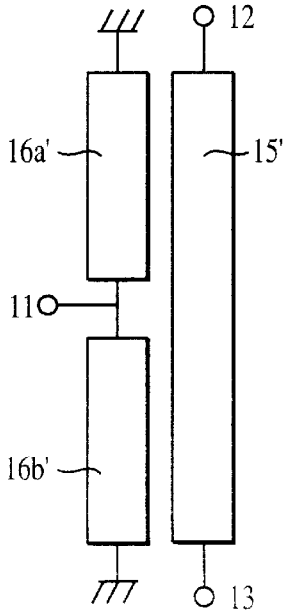
FIG. 2 is an equivalent circuit diagram of the balanced-unbalanced converter.

FIG. 2 is an equivalent circuit diagram of the balanced-unbalanced converter shown in FIG. 1. A microstrip line 15' corresponds to the microstrip line electrode 15 shown in FIG. 1, and microstrip lines 16*a*' and 16*b*' correspond to the microstrip line electrode 16 in FIG. 1, respectively. The microstrip line 15' having the open opposite ends, and the microstrip lines 16*a*' and 16*b*' each having one grounded end are arranged adjacently in parallel to each other, as described above. Therefore, the microstrip lines 15' and 16*a*' and 16*b*' are coupled to each other via an electromagnetic field. In this case, the ground ends of the microstrip lines 16*a*' and 16*b*' have a ground potential, and the potential of the terminal electrode 11 varies correspondingly to an unbalance input voltage with respect to the ground potential. As a result, output voltages having a phase difference of 180° are generated at both of the open ends of the microstrip line 15'. Thus, the terminal electrode 11 acts as an unbalanced input port, and the terminal electrodes 12 and 13 act as balanced output ports. Moreover, the terminal electrodes 12 and 13 may be employed as balanced input ports, and the terminal electrode 11 may be used as an unbalanced output port, due to the reversibility of the circuit.

Next, the configuration of a balanced-unbalanced converter according to a second embodiment of the present invention will be described with reference to FIGS. 3A and 3B.

Figure 3A:
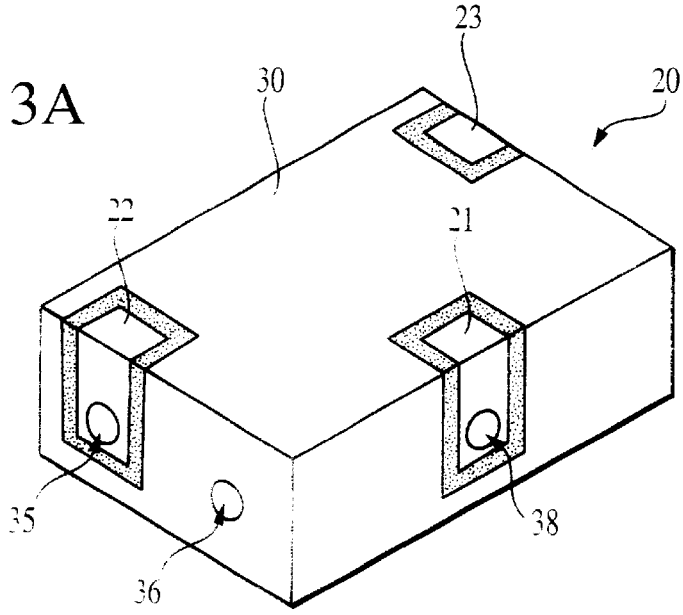
FIG. 3A is a perspective view showing the appearance of a balanced-unbalanced converter according to a second embodiment of the present invention.

FIG. 3A is a perspective view showing the appearance of the balanced-unbalanced converter. FIG. 3B is a cross section taken along the plane passing through two inner conductor formation holes 35 and 36 shown in FIG. 3A. When the converter is surface-mounted to a circuit substrate, the upper face as viewed in FIG. 3A of the converter is used as the mounting surface, which becomes opposed to the circuit substrate. Terminal electrodes 21, 22, and 23 are connected to signal input-output electrodes formed on the circuit substrate. An earth electrode on the circuit substrate is connected to an outer conductor 30.

A dielectric block 20 has a substantially rectangular parallelepiped shape as a whole, and is provided with three inner conductor formation holes 35, 36, and 38. The two inner conductor formation holes 35 and 36 of these holes are formed in parallel to each other. The inner conductor formation hole 38 is formed orthogonally to the inner conductor formation hole 36. Inner conductors 25, 26, and 28 are formed on the inner walls of the inner conductor formation holes 35, 36, and 38, respectively. On the outer surface of the dielectric block 20, terminal electrodes 22 and 23 are formed at both of the ends of the inner conductor formation hole 35 so as to be connected to the inner conductor 25 and separated from the outer conductor 30. Furthermore, a terminal electrode 21 is formed at the opening of the inner conductor formation hole 38 so as to be connected to the inner conductor 28 and separated from the outer conductor 30. On the other hand, both of the ends of the inner conductor 26 formed on the inner wall of the inner conductor formation hole 36 are connected to the outer conductor 30.

With this structure, a balanced-unbalanced converting circuit equivalent to that of FIG. 2 is formed. That is, the terminal electrode 21 acts as an unbalanced port, and the terminal electrodes 22 and 23 act as balanced ports.

Hereinafter, the configuration of a balanced-unbalanced converter having a function of multiplexing or demultiplexing according to a third embodiment of the present invention will be described with reference to FIGS. 4 and 5.

Figure 4:
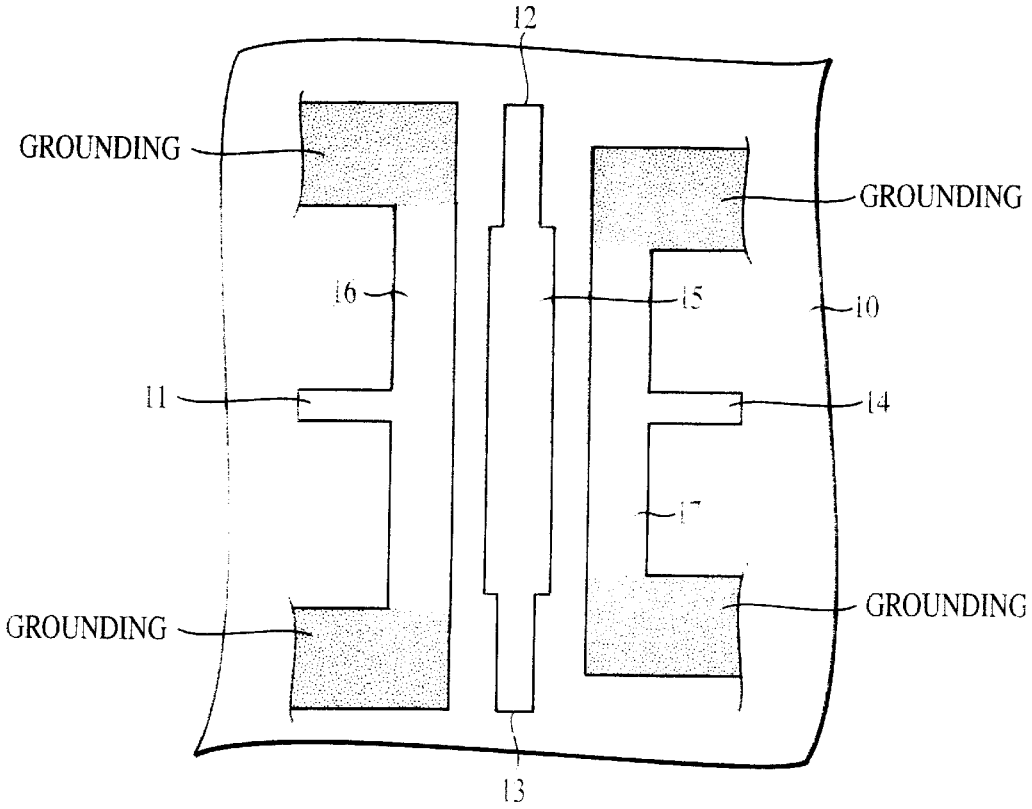
FIG. 4 illustrates the configuration of a balanced-unbalanced converter according to a third embodiment of the present invention.

FIG. 4 is a plane view of the balanced-unbalanced converter. Strip line electrodes 16 and 17 are arranged adjacently to and on both sides of a strip line electrode 15, on the upper face of a dielectric substrate 10. An earth electrode is formed substantially on the whole of the under face of the dielectric substrate 10. The dielectric substrate 10, the strip line electrodes 15, 16, and 17, and the earth electrode constitute microstrip lines, respectively. Terminal electrodes 11 and 14 are led out from the centers of the strip line electrodes 16 and 17, respectively. Terminal electrodes 12 and 13 are led out from both of the ends of the strip line electrode 15, respectively. Both of the ends of each strip line 16 and 17 are patterned so as to be connected to an earth electrode provided on the upper face of the dielectric substrate 10.

Figure 5:
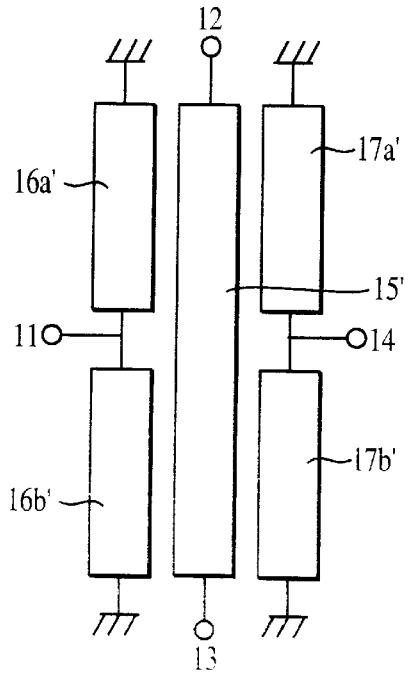
FIG. 5 is an equivalent circuit diagram of the balanced-unbalanced converter.

FIG. 5 is an equivalent circuit diagram of the balanced-unbalanced converter of FIG. 4. A microstrip line 15' corresponds to the strip line electrode 15 shown in FIG. 1. Microstrip lines 16*a*' and 16*b*' correspond to the microstrip line electrode 16 shown in FIG. 1. Microstrip lines 17*a*' and 17*b*' correspond to the microstrip line electrode 17 shown in FIG. 1. As described above, the microstrip line 15' having both of the ends opened and the microstrip line 16*a*' and 16*b*' having both of the ends grounded are arranged adjacently to and in parallel to each other to be coupled via an electromagnetic field. Similarly, the microstrip line 15' and the microstrip lines 17*a*' and 17*b*' are coupled to each other via an electromagnetic field.

The total electrical length of the microstrip lines 16*a*' and 16*b*' is different from that of the microstrip lines 17*a*' and 17*b*'. Furthermore, the electrical length of the microstrip line 15' is in the range between the total electrical length of the lines 16*a*' and 16*b*' and that of the lines 17*a*' and 17*b*'. Thereby, in the balanced-unbalanced converter of this embodiment, the microstrip line 15' and the microstrip lines 16*a*' and 16*b*' act as a balanced-unbalanced converter in a first frequency band, and simultaneously, the microstrip line 15' and the microstrip lines 17*a*' and 17*b*' act as a balanced-unbalanced converter in a second frequency band.

In particular, the balanced-unbalanced converter of this embodiment can be used as a multiplexer having a function of inputting signals in the first and second frequency bands via the terminal electrodes 11 and 14 as unbalanced input ports, and outputting the multiplexed signals from the terminal electrodes 12 and 13 as balanced output ports. Moreover, the balanced-unbalanced converter of this embodiment can be employed as a demultiplexer having a function of demultiplexing an input signal into signals in the first and second frequency bands by use of the terminal electrodes 12 and 13 as balanced input ports and the terminal electrodes 11 and 14 as unbalanced output ports. The difference between the electrical length of the microstrip line 15'and the overall electrical length of the microstrip lines 16*a*' and 16*b*', and the difference between the electrical length of the microstrip line 15' and the overall electrical length of the microstrip lines 17*a*' and 17*b*' are small. Accordingly, good multiplexing and demultiplexing characteristics in the above-mentioned first and second frequency bands can be obtained.

Hereinafter, the configuration of a balanced-unbalanced converter having a multiplexing or demultiplexing function according to a fourth embodiment of the present invention will be described with reference to FIGS. 6A and 6B.

Figure 6A:
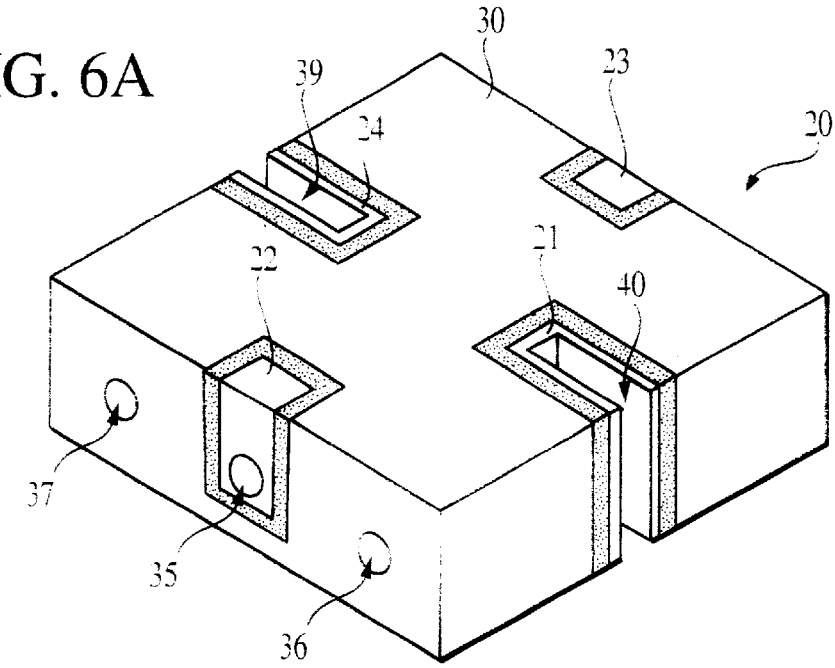
FIG. 6A is a perspective view showing the appearance of a balanced-unbalanced converter according to a fourth embodiment of the present invention.
Figure 6B:
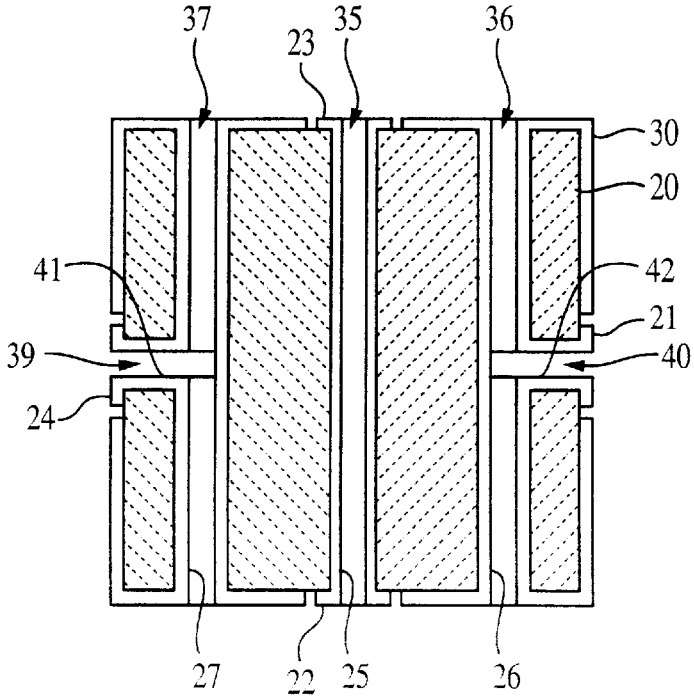
FIG. 6B is a cross section of the balanced-unbalanced converter.

FIG. 6A is a perspective view showing the appearance of the balanced-unbalanced converter. FIG. 6B is a cross section thereof taken along the plane passing through two inner conductor formation holes shown in FIG. 6A. The upper face as viewed in FIG. 6A of the balanced-unbalanced converter, when the converter is surface-mounted, is used as a mounting surface opposed to a circuit substrate. Terminal electrodes 21, 22, 23, and 24 are connected to signal input-output terminals provided on the circuit substrate, respectively. An outer conductor 30 is connected to an earth electrode on the circuit substrate.

A dielectric block 20 has a substantially rectangular parallelepiped shape as a whole, and is provided with three inner conductor formation holes 35, 36, and 37, and two slits 39 and 40. The three inner conductor formation holes 35, 36, and 37 are formed in parallel to each other. The slits 39 and 40 are formed orthogonally to the inner conductor formation holes 36 and 37, respectively. Inner conductors 25, 26, and 27 are formed on the inner walls of the inner conductor formation holes 35, 36, and 37, and inner conductors 41 and 42 are formed on the inner walls of slits 39 and 40, respectively. On the outer surface of the dielectric block 20, terminal electrodes 22 and 23 are formed at both of the ends of the inner conductor formation hole 35 so as to be connected to the inner conductor 25 and separated from an outer conductor 30. Terminal electrodes 21 and 24 are formed at the openings of the slits 39 and 40 so as to be connected to the inner conductor 41 and 42 and separated from the outer conductor 30. Both of the ends of the inner conductors 26 and 27 formed on the inner walls of the inner conductor formation holes 36 and 37 are connected to the outer conductor 30.

With this configuration, a multiplexer or demultiplexer is formed which contains the terminal electrodes 21 and 24 as unbalanced ports, and the terminal electrodes 22 and 23 as balanced ports, equivalently to the configuration of FIG. 5.

Hereinafter, the configuration of a balanced-unbalanced converter according to a fifth embodiment of the present invention will be described with reference to FIGS. 7A and 7B.

The whole configuration of the balanced-unbalanced converter of the fifth embodiment is similar to that of the converter of the second embodiment shown in FIG. 3. However, in the example of FIG. 3, the conductor films in the respective parts of the converter are ordinary single layer conductor films, respectively. In the fifth embodiment, each of the conductor films in the main parts comprises a thin film multilayer electrode. Descriptions of methods and structures for making such electrodes are presented in Ser. No. 08/604, 952 filed Feb. 27, 1996 (based on WO95/06336), incorporated by reference.

Figure 3B:
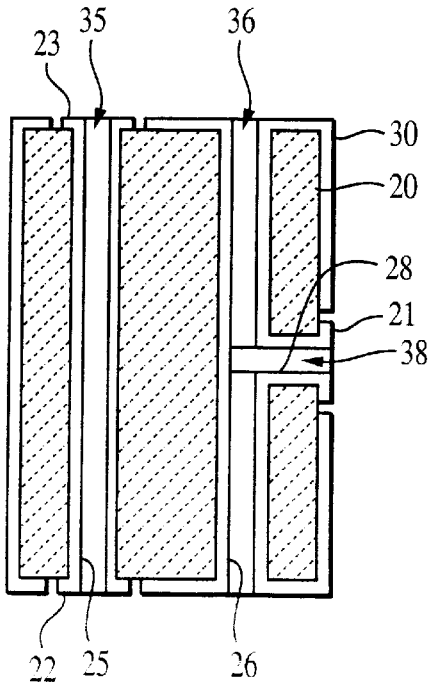
FIG. 3B is a cross section of the balanced-unbalanced converter.

FIG. 7A is a cross section of the converter taken along the same plane thereof as that of the second embodiment shown in FIG. 3B. FIG. 7B is an enlarged view of part C shown in FIG. 7A. In the enlarged view, the thickness of a dielectric block 20 is considerably shortened as compared with the thickness of the respective thin film conductor layers or the like. In FIG. 7B, thin film conductor layers 261 and 301, thin film dielectric layers 262 and 302, and outermost conductor layers 263 and 303 are shown. The thin film conductor layers 261 and 301 and the thin film dielectric layers 262 and 302 are alternately laminated to each other. Thus, the inner conductor 26 and the outer conductor 30 each having the thin film lamination electrode structure are formed. Conductor layers 263 and 303 having a large thickness are provided as the outermost layers, respectively, making the surfaces of the thin film lamination electrodes more durable.

An outer conductor 30' comprising a single layer electrode having a thickness at least three times the skin depth at an operating frequency is formed on a short circuiting face of the dielectric block 20 so as to connect the inner conductor 26 and the outer conductor 30 each having the thin film lamination electrode structure, and also, connecting the respective thin film conductor layers to each other.

Similarly, the part of the inner conductor 25 has a thin film multilayer electrode structure.

With this electrode structure, electric currents flowing in the thin film conductor layers contained in each thin film multilayer electrode are in phase with each other, due to the single layer electrode formed on the short-circuiting face. That is, the advantageous effects caused by currents dispersed and flowing in the respective thin film conductor layers can be retained (see WO95/06336), whereby the effective sectional area is increased, and the conductor loss caused by the skin effect is reduced. As a result, a low insertion loss can be obtained.

Hereinafter, the configuration of a communication device including the above-described balanced-unbalanced converter will be described with reference to FIG. 8.

Figure 8:
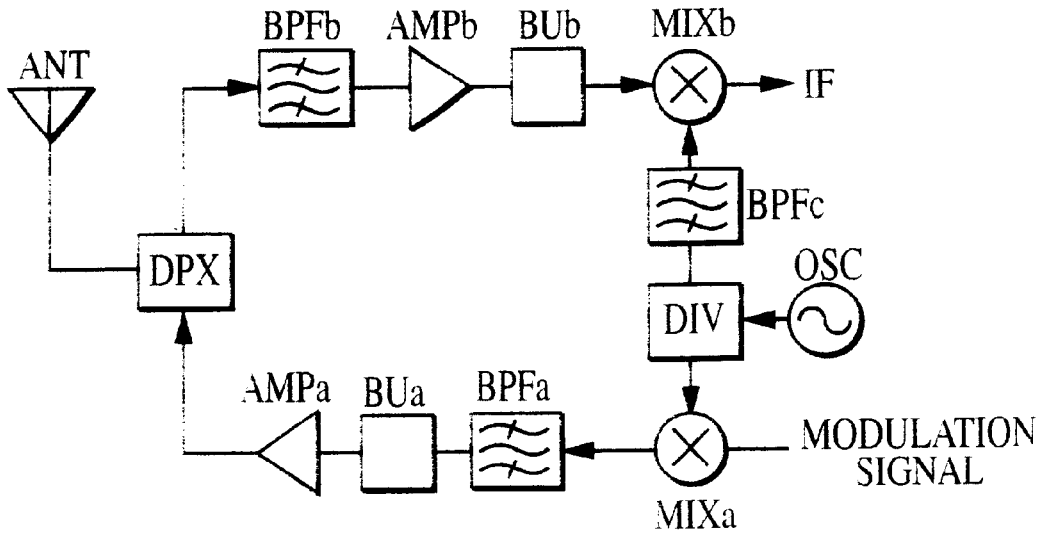
FIG. 8 is a block diagram showing the configuration of a communication device according to a sixth embodiment of the present invention.
Figure 9:
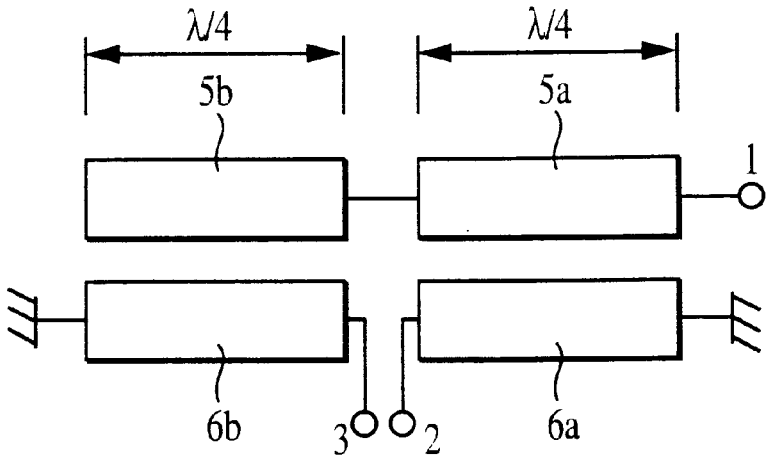
FIG. 9 PRIOR ART
FIG. 9 illustrates the configuration of a conventional balanced-unbalanced converter.

In FIG. 8, a transmission-reception antenna ANT, a duplexer DPX, band-pass filters BPFa, BPFb, and BPFc, amplifier circuits AMPa and AMPb, balanced-unbalanced converters BUa and BUb, mixers MIXa and MIXb, an oscillator OSC, and a frequency divider (synthesizer) DIV constitutes the communication device. The mixer MIXa modulates a frequency signal output from the frequency divider DIV, with a modulation signal. The band-pass filter BPFa transmits only a signal within a transmission frequency band. The amplifier circuit AMPa power-amplifies the signal, and transmits the signal from the antenna ANT via the duplexer DPX. The band-pass filter BPFb transmits only a signal output from the duplexer DPX and within a reception frequency band. The amplifier circuit AMPb amplifies the signal. The mixer MIXb mixes a frequency signal output from the band-pass filter BPFc and the reception signal to output an intermediate frequency signal IF.

In FIG. 8, the amplifier circuit AMPa is a balanced input type amplifier circuit, and the amplifier circuit AMPb is an unbalanced output type amplifier circuit. The balanced-unbalanced converter BUa converts an unbalanced output signal from the band-pass filter BPFa to a balanced signal, and feeds the signal to the amplifier circuit AMPa. The balanced-unbalanced converter BUb converts an unbalanced output signal from the amplifier circuit AMPb to a balanced signal, and feeds the signal to the mixer MIXb.

Hereinafter, the configuration of a balanced-unbalanced converter having a function of multiplexing or demultiplexing according to a seventh embodiment of the present invention will be described with reference to FIGS. 10 and 11.

Figure 10:
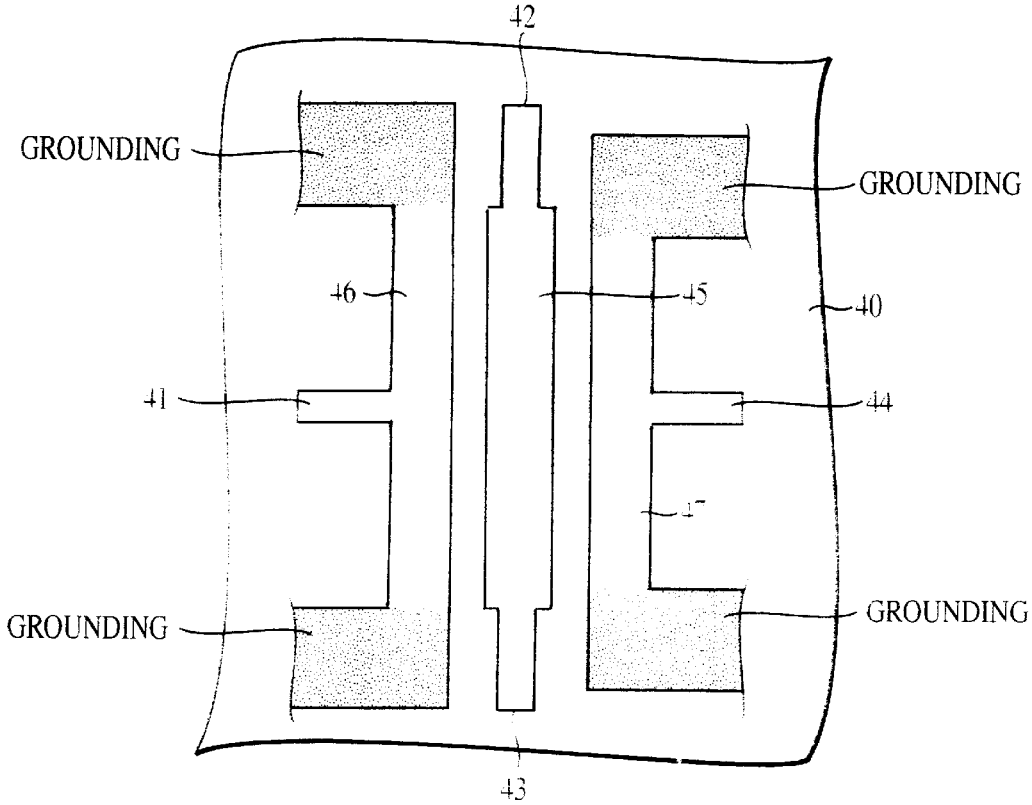
FIG. 10 demonstrates the configuration of a balanced-unbalanced converter according to a seventh embodiment of the invention.

FIG. 10 is a plane view of the balanced-unbalanced converter. Strip line electrodes 46 and 47 are arranged adjacently to and on both sides of a strip line electrode 45, on the upper face of a dielectric substrate 40. An earth electrode is formed substantially on the whole of the under face of the dielectric substrate 40. The dielectric substrate 40, the strip line electrodes 45, 46, and 47, and the earth electrode constitute microstrip lines, respectively. Terminal electrodes 41 and 44 are led out from the centers of the strip line electrodes 46 and 47, respectively. Terminal electrodes 42 and 43 are led out from both of the ends of the strip line electrode 45, respectively. Both of the ends of each strip line 46 and 47 are patterned so as to be connected to an earth electrode provided on the upper face of the dielectric substrate 40.

Figure 11:
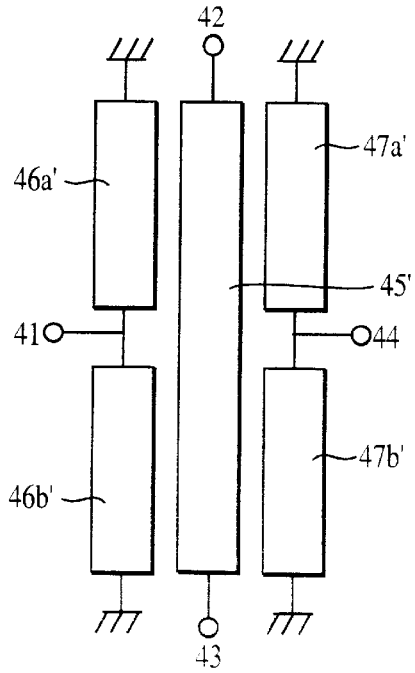
FIG. 11 is an equivalent circuit diagram of the balanced-unbalanced converter of FIG. 10.

FIG. 11 is an equivalent circuit diagram of the balanced-unbalanced converter of FIG. 10. A microstrip line 45' corresponds to the strip line electrode 45 shown in FIG. 1. Microstrip lines 46*a*' and 46*b*' correspond to the microstrip line electrode 46 shown in FIG. 1. Microstrip lines 47*a*' and 47*b*' correspond to the microstrip line electrode 47 shown in FIG. 1. As described above, the microstrip line 45' having both of the ends opened and the microstrip line 46*a*' and 46*b*' having both of the ends grounded are arranged adjacently to and in parallel to each other to be coupled via an electromagnetic field. Similarly, the microstrip line 45' and the microstrip lines 47*a*' and 47*b*' are coupled to each other via an electromagnetic field.

The total electrical length of the microstrip lines 46*a*' and 46*b*' is different from that of the microstrip lines 47*a*' and 47*b*'. Furthermore, the electrical length of the microstrip line 45' is substantially the same as the total electrical length of the lines 46*a*' and 46*b*'. Thereby, in the balanced-unbalanced converter of this embodiment, the microstrip line 45' and the microstrip lines 46*a*' and 46*b*' act as a balanced-unbalanced converter in a first frequency band, and simultaneously, the microstrip line 45' and the microstrip lines 47*a*' and 47*b*' act as a balanced-unbalanced converter in a second frequency band.

In particular, the balanced-unbalanced converter of this embodiment can be used as a multiplexer having a function of inputting signals in the first and second frequency bands via the terminal electrodes 41 and 44 as unbalanced input ports, and outputting the multiplexed signals from the terminal electrodes 42 and 43 as balanced output ports. Moreover, the balanced-unbalanced converter of this embodiment can be employed as a demultiplexer having a function of demultiplexing an input signal into signals in the first and second frequency bands by use of the terminal electrodes 42 and 43 as balanced input ports and the terminal electrodes 41 and 44 as unbalanced output ports. The difference between the electrical length of the microstrip line 45' and the overall electrical length of the microstrip lines 47*a*' and 47*b*' is small. Accordingly, good multiplexing and demultiplexing characteristics in the above-mentioned first and second frequency bands can be obtained.

In the examples shown in FIGS. 1, 4 and 10, the transmission lines each comprise microstrip lines. Alternatively, the transmission lines may comprise strip lines produced by forming a respective dielectric layer and earth electrode on each of the upper and under faces of a strip line electrode, respectively.

In the examples shown in FIGS. 3, 6, and 7, the coaxial transmission lines are formed by use of the single dielectric blocks, respectively. Alternatively, two dielectric sheets each having a groove formed thereon may be used. Inner conductors are formed on the inner walls of the grooves, and outer conductors are formed on the back faces of the dielectric sheets, respectively. Then, the two dielectric sheets are bonded to each other, so that the balanced-unbalanced converter including the formed coaxial structure transmission lines is produced.

According to the present invention, the interval between the balanced ports can be made relatively wide, and the balanced ports (parallel input-output terminals) can be easily connected to transmission lines due to the configuration. Therefore, no unnecessary coupling between the parallel terminals occurs, and an excellent balance characteristic can be obtained.

By providing the first, second, and third transmission lines, the balanced-unbalanced converting circuit can be used as a three port type provided with one balanced port and two unbalanced ports, and having a function of multiplexing or demultiplexing a signal. Furthermore, the balanced-unbalanced converting circuit can be reduced in size as a whole.

The electrical length of the above-described first transmission line may be set to be in the range between the electrical lengths of the second and third transmission lines; or, as another example, the electrical length of the first transmission line may be substantially equal to that of the third transmission line. Accordingly, a balanced-unbalanced converter made up of the first and second transmission lines, and a balanced-unbalanced converting circuit made up of the first and third transmission lines exhibit good balanced-unbalanced conversion characteristics with respect to two frequency bands. That is, for the two frequency bands, good multiplexing or demultiplexing characteristics can be attained.

The transmission lines may comprise microstrip or strip lines produced by forming conductor films on a dielectric substrate, respectively. Thereby, the balanced-unbalanced converter including the dielectric substrate can be simply formed. In addition, the balanced-unbalanced converter can be easily connected to other high frequency circuits.

Moreover, the transmission lines may comprise the dielectric coaxial lines produced by forming conductor films in a dielectric block, respectively. Thereby, a small-sized balanced-unbalanced converter having low loss and low unnecessary radiation characteristics can be simply obtained.

Preferably, at least a part of at least one of the conductor films is a thin film multilayer electrode having an area in which plural thin film conductor layers and plural thin film dielectric layers, each having a thickness smaller than the skin depth at an operating frequency are alternately laminated. Thereby, the effective sectional area of the thin film lamination electrode is increased. The conductor loss, caused by the skin effect, is reduced. Thus, a balanced-unbalanced converter having a low loss can be obtained.

According to the present invention, a communication device reduced in size, having a high efficiency can be obtained.

Although the present invention has been described in relation to particular embodiments thereof, many other variations and modifications and other uses will become apparent to those skilled in the art. Therefore, the present invention is not limited by the specific disclosure herein.

What is claimed is:

1. A balanced-unbalanced converting circuit comprising:

a first transmission line having two open ends; and a second transmission line having two grounded ends, arranged substantially in parallel to the first transmission line;

said first transmission line having two balanced ports connected respectively to the ends thereof; and said second transmission line having an unbalanced port connected substantially to the center thereof.

2. A balanced-unbalanced converting circuit according to claim 1, wherein said first and second transmission lines have electrical lengths that are substantially equal.

3. A balanced-unbalanced converting circuit according to claim 1, further comprising:

a third transmission line having two grounded ends, provided substantially in parallel to the first transmission line, the electrical length of the third transmission line being substantially equal to the electrical length of the first transmission line and being different from the electrical length of the second transmission line;

wherein the third transmission line has an unbalanced port connected substantially to the center thereof.

4. A balanced-unbalanced converting circuit according to claim 1, further comprising:

a third transmission line having two grounded ends, provided substantially in parallel to the first transmission line, the electrical length of the first transmission line being in a range between the electrical lengths of the second and third transmission lines;

wherein the third transmission line has an unbalanced port connected substantially to the center thereof.

5. A balanced-unbalanced converter including the transmission lines defined in any one of claims 1–4, each transmission line comprising a microstrip line or strip line comprising a conductor film formed on a dielectric substrate.

6. A balanced-unbalanced converter according to claim 5, wherein at least a part of at least one of the conductor films comprises a thin film multilayer electrode having an area in which plural thin film conductor layers and plural thin film dielectric layers, each having a thickness smaller than the skin depth at an operating frequency, are alternately laminated.

7. A balanced-unbalanced converter including the transmission lines defined in any one of claims 1–4, each comprising a dielectric coaxial transmission line comprising a conductor film formed in a dielectric block.

8. A balanced-unbalanced converter according to claim 7, wherein at least a part of at least one of the conductor films comprises a thin film multilayer electrode having an area in which plural thin film conductor layers and plural thin film dielectric layers, each having a thickness smaller than the skin depth at an operating frequency, are alternately laminated.

9. A communication device including a balanced-unbalanced converter as defined in any one of claims 1–4;

a high-frequency circuit comprising at least one of a transmitting circuit and a receiving circuit, said high-frequency circuit having a plurality of components;

wherein two of said components are interconnected by said balanced-unbalanced converter.

* * * * *